United States Patent [19]

Reisser et al.

[11] 4,154,409

[45] May 15, 1979

[54] METHOD AND DEVICE FOR SECURING A RESERVE WINDING ON A TUBE

[75] Inventors: Gerd Reisser; Kurt Lovas, both of Ingolstadt, Fed. Rep. of Germany

[73] Assignee: Schubert & Salzer, Ingolstadt, Fed. Rep. of Germany

[21] Appl. No.: 724,521

[22] Filed: Sep. 20, 1976

[30] Foreign Application Priority Data

Oct. 2, 1975 [DE] Fed. Rep. of Germany ..... 2543986

[51] Int. Cl.[2] ..... B65H 54/02

[52] U.S. Cl. ..... 242/18 PW; 242/125.1

[58] Field of Search ..... 242/18 PW, 18 A, 125.1; 57/34 TT

[56] References Cited

U.S. PATENT DOCUMENTS

| | | | |
|---|---|---|---|
| 2,221,999 | 11/1940 | Reiners et al. | 242/18 PW UX |
| 2,824,708 | 2/1958 | Higgins | 242/125.1 |
| 2,949,722 | 8/1960 | Henry et al. | 57/34 TT |
| 3,118,633 | 1/1964 | Belville | 242/125.1 |
| 3,237,876 | 3/1966 | Franzen | 242/18 PW |
| 3,275,252 | 9/1966 | Bolger | 242/18 PW |
| 3,468,496 | 9/1969 | Limantour | 242/125.1 |
| 3,814,347 | 6/1974 | Moren, Jr. | 242/18 PW X |
| 3,920,193 | 11/1975 | Gujer et al. | 242/18 PW X |
| 3,940,075 | 2/1976 | Lenk | 242/18 PW |
| 3,974,972 | 8/1976 | Egli et al. | 242/18 PW |

FOREIGN PATENT DOCUMENTS

| | | | |
|---|---|---|---|
| 1038422 | 8/1966 | United Kingdom | 242/18 PW |

*Primary Examiner*—Stanley N. Gilreath
*Attorney, Agent, or Firm*—Bailey, Dority & Flint

[57] ABSTRACT

A device and method for securing a reserve winding of thread on a tube supported on winding apparatus having a main thread guide and a thread delivery source wherein a reserve winding is formed from thread extending to a thread-holding device and thereafterwards severed with the free end of the reserve thread deflected toward the longitudinal center of the tube and covered with thread subsequently laid by the main thread guide.

11 Claims, 9 Drawing Figures

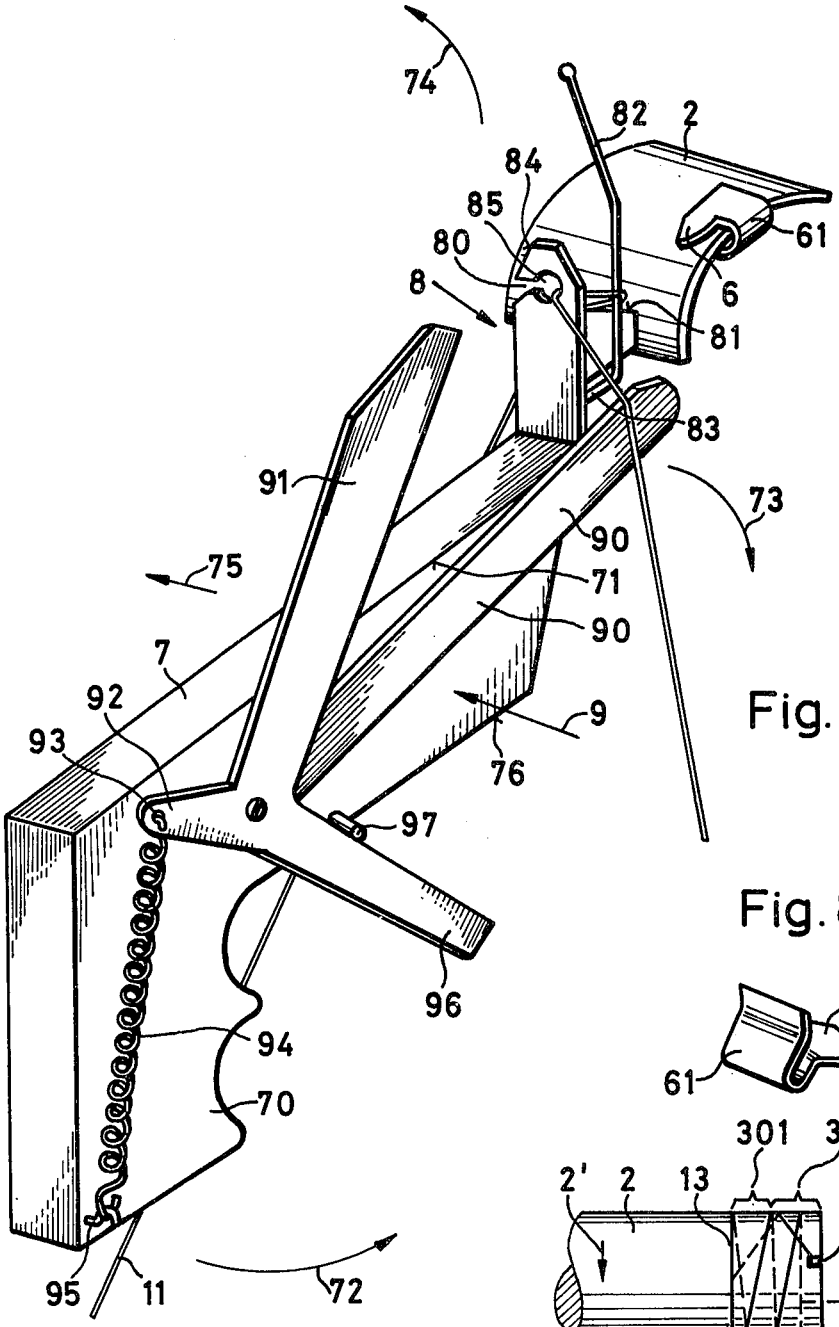
Fig. 7
Fig. 8
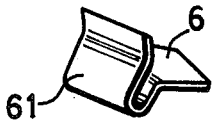
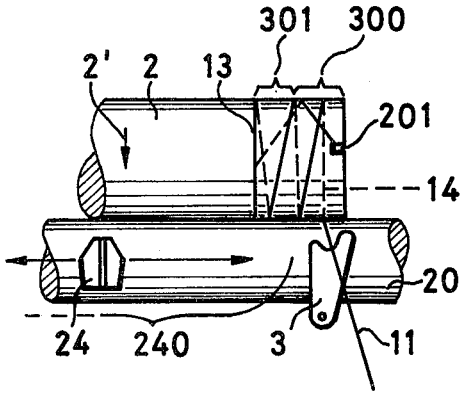
Fig. 9

METHOD AND DEVICE FOR SECURING A RESERVE WINDING ON A TUBE

BACKGROUND OF THE INVENTION

The present invention relates to a method of securing a reserve winding on a tube and a device for carrying out this method.

It is already known to grasp the thread extending to a thread-holding device and pull it out to the empty bobbin tube while introducing it into the gripping line of the winding device (DT-OS 2.332.327). In the course of this, the thread is gripped between the end of the tube and a member rotating with the tube and a thread reserve is formed from the length of thread between nip point and delivery point. When the finished bobbin is removed from the bobbin holder, there is a risk that the end of the thread reserve, which is not secured to the end of the bobbin, may unwind and tear off. There is also a risk of unwinding and tearing during transport, so that, in some circumstances, no thread reserve is available during the processing for connection to the beginning of a thread of a fresh bobbin.

It is also known to guide the thread between a pneumatic thread-holding device and the tube in the region of the reserve winding which is provided, while the reserve winding is composed of the thread produced by the thread-holding device (DT-OS 2.431.145). For this purpose, however, the thread must wrap around the tube, which complicates the changing of the bobbin. Apart from this, the end of the thread of the reserve winding is unsecured, so that the disadvantages outlined above also occur here.

It is also known to provide a thread-catching element at the end of the tube, extending axially beyond the end of the tube (FR-PS 2.098.134). This is not in a position to secure the end of the thread, however. It is further known to provide an incision or a notch at the end of the tube (DT-OSen 2.204,674, 2.330.961 and 2.347.644). The incision or the notch is enlarged with time so that, in the long run, no reliable holding of the end of the thread can be ensured by this means.

SUMMARY OF THE INVENTION

According to the invention, the problem of securing the reserve winding is solved by deflecting the free end of the thread towards the center of the tube and covering the free end by the turns later laid by the traversing thread guide. In order to simplify operation, the length of thread necessary for the formation of the reserve winding can be withdrawn from the thread extending from the bobbin into a pneumatic thread-holding device and after a sufficiently large reserve winding has been built up the thread extending to the thread-holding device can be severed, after which the end of the thread thus produced is deflected towards the center of the tube where it is covered by the turns laid by the traversing thread guide.

It has been found that a device can be had for securing a reserve winding on a bobbin tube supported by winding apparatus having a thread delivery source, drive means for rotating the tube causing the thread to be wound thereon, a traversing thread guide member for traversing the tube uniformly winding the thread along the length thereof, and a thread-holding device disposed in the vicinity of a path of the thread from the thread delivery to the tube for receiving and holding a portion of the thread. In one embodiment, the device comprises an auxiliary thread guide disposed in the region of the reserve winding between the thread-holding device and the tube for receiving and guiding the thread to the tube for forming the reserve winding. A thread catching means is carried by the tube for grasping the thread guided by the auxiliary thread guide initiating the reserve winding. The auxiliary thread guide is movably carried adjacent the tube for movement towards the longitudinal center of the tube for deflecting the thread guided thereby towards the center of the tube causing a free end of the reserve winding to be wound under thread laid by the traversing thread guide securing the reserve winding on the tube.

The auxiliary thread guide, which is movable towards the center of the tube, advantageously comprises two thread-deflection guides, between which the thread is guided parallel to the surface of the tube. The tube comprises a thread-catching projection orientated in the direction of rotation of the tube in the region between the two thread-deflection guides. In order to be able to produce these tubes in a simple manner, for example from conventional smooth tubes, the thread-catching projection can be fitted to the tube. The auxiliary thread guide can be disposed stationary at any working point. Preferably, however, a holder, on which the auxiliary thread guide can be mounted, is provided in front of the winding roller.

According to a further embodiment of the subject of the invention, the tube comprises a thread-catching projection orientated in the direction of rotation of the tube at its edge. A holder is provided which receives the thread extending to the thread-holding device and is movable in the working range of the thread-catching projection and which carries two thread-deflection guides between which the thread can be guided substantially transversely to the path of movement of the thread-catching projection. If the thread reserve is formed in the manner hitherto known, for example in accordance with the DT-OS 2.332.327, without the end of the thread being taken under the main turns, then the auxiliary thread guide may also be omitted.

The holder preferably carries the auxiliary thread guide. A cutting device may advantageously be disposed in the vicinity of the thread deflection guide remote from the tube.

Since the end of the thread reserve comes under the normal turns of the bobbin as a result of movement of the auxiliary thread guide towards the center of the tube, it is secured against accidental release and tearing off. On the other hand, the end of the thread can easily be pulled out from under the normal turns, when needed, so that the thread reserve is available for connection to the beginning of another bobbin. If the tube has a rough surface, then this roughness forms the thread-catching member so that no special tubes are necessary. Normal tubes can easily be provided subsequently with a separate thread-catching member by fitting one on.

Accordingly, an important object of the present invention is to provide a method and a device which render possible the formation of thread reserves with a secured free end of the thread on a tube in a simple manner.

Further details of the invention are explained in moe detail below with reference to the drawings.

BRIEF DESCRIPTION OF THE DRAWINGS

FIG. 7 shows a preferred embodiment of the subject of the invention, in perspective, FIG. 8 shows a thread-catching projection which can be fitted to the tube, and FIG. 9 shows the winding device with a thread reserve secured according to the invention.

DESCRIPTION OF A PREFERRED EMBODIMENT

Figure 1:
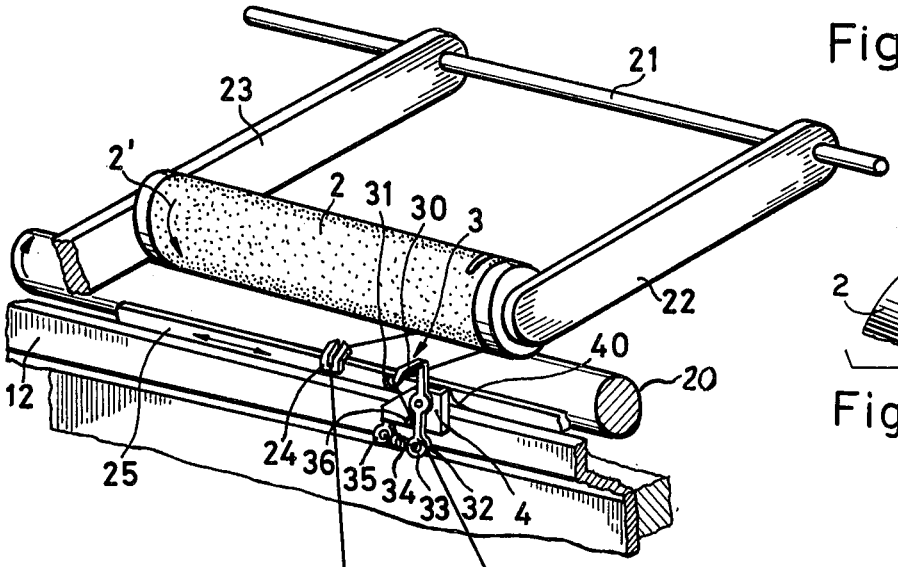
FIG. 1 shows a winding device with the device according to the invention, illustrated in perspective.

The invention can be used on various textile machines, for example on a winding frame or an open-end spinning machine. For the sake of simplicity and for the purpose of illustrating a preferred embodiment, reference is made below to an open-end spinning machine.

In the open-end spinning machine, the thread delivered from the spinning compartment (not shown) in continuously drawn off by delivery rollers 1, 10 and wound on a bobbin tube 2 which, in the working position shown, is driven by frictional engagement by a winding roller 20. In the embodiment shown, the tube 2 is resiliently gripped between two bobbin holders 22 and 23 which are pivotable about a pin 21. Disposed in front of the winding roller 20 is a main thread guide 24 which is secured to a traversing rod 25 across which the guide 24 traverses.

Secured between the delivery rollers 1, 10 and the winding roller 20 is suction conduit 26 with a vacuum nozzle 27, which can be closed by a cover 28. A thread-tension equalizing bow 29 is further provided on the suction conduit 26.

For the formation of the thread reserve, an auxiliary thread guide 3 is provided which is pivotably secured to a holder 4 such that the guide 3 can be pivoted parallel to the axis of the bobbin tube 2. The auxiliary thread guide 3 comprises an arm 30, which is bent generally perpendicular to the plane of pivoting and carries at its end the actual thread guide 31, and a second arm 32 with a spring eye 33 at its end, in which a tension spring 34 is hooked. A spring hook 35 for the tension spring 34 is provided in the holder 4, so that the auxiliary thread guide 3 is held bearing against a stop 36. The holder 3 can be mounted on a holding means 12 which is disposed, in the form of a casing in front of the winding roller 20 and in front of the rod 25, for which purpose it is equipped with a spring clip 40.

Figure 3:
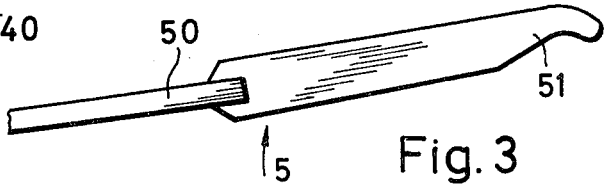
FIG. 3 shows, in side view, an auxiliary tool for introducing the thread into the gripping line between winding roller and tube.

A gripper 5, which comprises a handle 50 and a thread guide 51 made of sheet metal, is used to carry out the method according to the invention (FIG. 3). If a change of bobbins is to be carried out, then, while simultaneously lifting the full bobbin (not shown) from the winding roller 20, the thread 11 is severed between the delivery rollers 1, 10 and the bobbin 2 and the beginning of the thread supplied by the delivery rollers 1, 10 is introduced into the vacuum nozzle 27. Thus, the thread extends along the broken line 11' directly from the delivery rollers 1, 10 to the vacuum nozzle 27.

The full bobbin is now exchanged for an empty tube 2, and the tube 2 is now lowered onto the winding roller 20 and driven in the direction of the arrow 2'. The operator now grasps the thread extending along the line 11' by means of the gripper 5 and guides the thread 11 over the thread guide 31 into the gripping line between the tube 2 and the winding roller 20. As a result of the roughness of the tube 2, the thread 11 is entrained by the tube 2 until it rotates. The length of thread now extending from this gripping line to the delivery rollers 1, 10 assumes a position inclined towards the center of the working point of the auxiliary thread guide 31, as a result of the thread being tensioned over the tension bow 29 and so comes within the traversing range of the thread guide 24. The thread guide 24 is constructed in the form of an automatic threader which automatically traverses across the length of tube 2.

Figure 2:
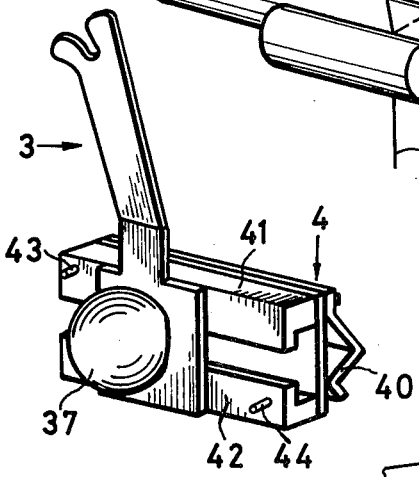
FIG. 2 shows an auxiliary thread guide, illustrated in perspective, by means of which the method according to the invention can be carried out.

The thread 11 subsequently supplied by the delivery rollers 1, 10 is thus traversed in the usual manner and wound on the tube 2. The other length of thread, which extends from the tube 2 over the thread guide 31 to the vacuum nozzle 27, now forms reserve windings as a result of the corresponding arrangement of the auxiliary thread guide 3 outside the traversing range of the thread guide 24. After a sufficient number of reserve windings, the auxiliary thread guide 3 is pivoted towards the longitudinal center of the tube, against the action of the tension spring 34, and at the same time the end of the thread extending to the vacuum nozzle 27 is severed. This can be effected by tearing off or cutting off. The resulting free end of the thread is now in the region of the traversing thread guide 24 and is thus covered by the main thread windings laid by this. The end of the thread is thus secured against accidentally falling off during transport after removal of the full bobbin. When the end of the thread has to be connected to the beginning of the next bobbin, however, during the subsequent processing of the thread 11 wound on the full bobbin, this is possible in a simple manner. During the axial withdrawal of the reserve windings from the tube 2, the end of the thread covered by the normal windings is also pulled from under the normal windings. According to FIG. 1, the auxiliary thread guide 3 is movable towards the center of the tube by pivoting. It is also possible, however, to mount the auxiliary thread guide 3 for linear displacement on the holder. FIG. 2 shows such an embodiment. For example, the holder 4 has two guide rails 41 and 42 between which the auxiliary thread guide 3 is mounted for sliding. For the movement of the auxiliary thread guide 3, this comprises a handle member 37, while the travel distance is limited by stops 43 and 44 provided on the guide rails 41 and 42.

Figure 5:
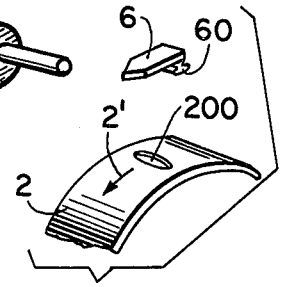
FIGS. 4 and 5 show in side view and in perspective, part of the tube provided with a thread-catching projection.
Figure 4:
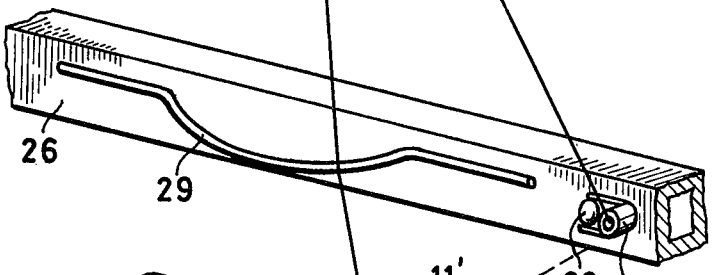
Figure 4:
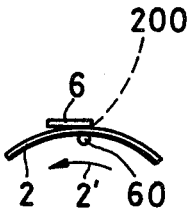

As the above dsscription shows, the surface of the tube 2 serves as a thread-catching member, this surface having great roughness for this purpose, for example. The surface of the tube 2 may also be smooth, however, if assurance is provided, as a result of suitable selection of material, that the thread 11 clings to this by adhesion, for example as a result of electrical charging of the tube 2. Generally, however, rough or electrically charged tubes 2 are not wanted. In this case, a thread-catching projection 6 (FIGS. 4 to 6) is provided on the tube 2, and may be rigidly or removably connected to the tube 2. For example, a recess 200 constructed in the form of a slot may advantageously be provided in the tube 2, in which the thread-catching projection 6 can be secured by an engaging extension 60. With this construction of the tube 2, the auxiliary thread guide 3 comprises two thread-deflecting guides 38 and 39, between which the thread 11 is guided parallel to the tube 2 (FIG. 6).

Figure 6:
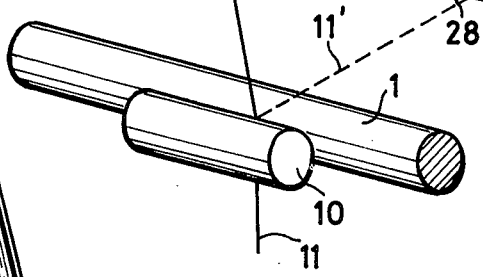
FIG. 6 shows an auxiliary thread guide in front view, which is adapted to cooperate with a tube constructed as shown in FIGS. 4 and 5.
Figure 6:
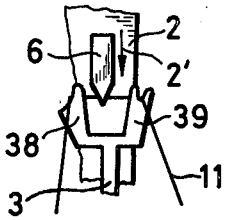

As FIG. 6 shows, the thread-catching projection 6 engages, on rotation of the tube 2 in the direction of the arrow 2', over the thread 11 stretched between the thread-deflection guides 38 and 39 and pulls it into the gripping line between winding roller 20 and tube 2. The length of thread extending to the delivery rollers 1, 10 slides off the thread-deflection guide 38 in the course of this and comes within the traversing range of the thread guide 24, in which it is automatically threaded. The other length of thread, which extends to the vacuum nozzle 27, forms the reserve windings until, when the required number of turns is reached, the end of the thread resulting from cutting or tearing is brought within range of the traversing thread guide 24 by pivoting (according to FIG. 1) or displacing (according to FIG. 2) the auxiliary thread guide 3. As described previously, the end of the thread is thus covered by the subsequent normal thread windings.

The thread-catching projection 6 can also be interchangeably secured to any commercial tube 2, without this having to be altered or processed in any way (FIGS. 7 and 8). In this case, its holding means is constructed in the form of a spring clip 61 by means of which the thread-catching projection 6 is merely pushed over the tube 2 from the side. This embodiment has the particular advantage that the thread-catching projection 6 can be withdrawn from the tube 2 without the reserve windings being adversely affected in the course of this.

According to the embodiments shown, the holder 4 with the auxiliary thread guide 3 is interchangeably connected to the working point. This is not absolutely essential, however. Instead, the holder can be disposed fixed at the working point. On the other hand, it is also possible to construct the holder 4 so that it is not connected to the winding point at the working station even during work. FIG. 7 shows such an embodiment of the device according to the invention.

The auxiliary thread guide 8 is mounted on one end of a holder 7, at the other end of which there is provided a handle 70. The auxiliary thread guide 8 is open at the side adjacent to the center of the tube (opening 80). The auxiliary thread guide 8 may be appropriately made of sheet metal, which is bent over at the side adjacent to the center of the tube towards the side remote from the handle 70 and forms, with its upper edge, a ramp serving as a thread-deflection guide 81. Disposed centrally on the auxiliary thread guide 8, at the side remote from the handle 70 of the holder 7, is a wire loop which serves as a thread-deflection guide 82 and which extends parallel to the auxiliary thread guide 8 and is held spaced apart from the auxiliary thread guide by the section of wire 83.

A shears-like cutting device 9 is provided at the side of the holder 7 remote from the opening 80 in the auxiliary thread guide 8, that is to say at the side of the holder 7 adjacent to the pneumatic thread-holding device constructed in the form of a vacuum nozzle 27. The cutting device 9 comprises a first stationary cutting edge 90 which is rigidly connected to the holder 7 or is formed by the edge 71 of the holder 7. The second, movable cutting edge 91 is pivotally mounted on the holder 7, at its end adjacent to the handle 70. The cutting edge 91 forms the first arm of a three-armed lever. A further arm 92 carries a spring eye 93 for a tension spring 94, the other end of which is anchored in a spring hook 95 carried by the holder. The purpose of the tension spring 94 is to hold the cutting edge 91 always removed from the cutting edge 90 when the cutting device is in the open position. The third arm serves as an actuating arm 96. On actuation of this actuating arm 96, which, in the normal position, always bears against a stop 97 carried by the holder 7, the cutting edge 91 is pivoted towards the cutting edge 90 against the action of the tension spring 94, while, on its release, the tension spring 94 again removes the cutting edge 91 from the cutting edge 90 until the actuating arm 96 again bears against the stop 97.

The change of bobbins again takes place in the manner described above, the thread 11 being severed and introduced into the vacuum nozzle 27. The tube 2 is now lowered and driven by the winding roller 20. In the position shown, the holder 7 is brought closer to the thread 11 extending from the delivery rollers 1, 10 to the vacuum nozzle 27, and the thread deflection guide 82 is brought to bear against the thread 11. The holder 7 is pivoted in the direction of the arrows 72 and 73 until the thread 11 bears against the edge 84 of the auxiliary thread guide 8 and finally slides through the opening 80 into the thread-guide eye 85. The holder is now turned back in the opposite direction to the arrows 72 and 73, in the course of which the ramp-like thread-deflection guide 81 grasps the thread 11. When the holder 7 has reached the position shown, it is lifted forwards in the direction of the arrow 74 and in this pivoted position, it is moved towards the tube 2 and held in front of the thread-catching projection 6. The thread-catching projection 6 grasps the section of thread between the thread-deflection guides 81 and 82. The length of thread extending to the delivery rollers 1, 10 comes within range of the traversing thread guide 24 (FIG. 1), while the thread extending to the vacuum nozzle 27 forms the reserve windings. When a sufficient number of thread windings has been formed, the holder 7 is moved somewhat in the direction of the arrow 75 and at the same time the actuating arm 96 is pulled towards the handle 70. The thread 11 which extends to the vacuum nozzle 27 and which has been automatically guided over the cutting edge 90, is severed thereby, while the end of the thread is moved towards the center of the tube and as a result comes under the normal bobbin windings subsequently produced. As the above description shows, the device according to the invention can be modified in many ways. For example, it is also possible to provide a guide (not shown) at the front lower edge 76 of the holder 7, which guide is mounted on the holding means 12 (FIG. 1) along which it can then be moved by displacement. It is further possible to provide a ramp which drops towards the center of the tube on the holding means 12. A further lever arm may be connected to the cutting device 9, which lever arm slides along the ramp when the cutting device 9 is closed and automatically displaces the holder 7 towards the center of the tube.

In the above description it has always been tacitly assumed that the pneumatic thread-holding device constructed in the form of a vacuum nozzle 27 was on the right of the winding station because then the operation is adapted for right-handed people. Thus, the reserve windings are likewise produced at the right-hand side of the tube 2. Naturally, a reverse arrangement is also possible, if this should be desired.

The device according to the invention is simple in construction. It is preferably not connected to the winding station because otherwise, in the modern machines with a large number of working stations, a correspondingly large number of devices constructed according to the invention would be necessary. The device is preferably constructed simultaneously as a gripper as shown in FIG. 7, because then the operator merely has to take one tool with him.

The method according to the invention renders possible the production of reserve windings which are secured against accidental falling off, in a simple manner. The method according to the invention does not necessitate any alteration to the winding apparatus, so that the invention can be used subsequently on any winding apparatus. Nor is the invention restricted to use on open-end spinning machines, but may also be used on winding machines in which the thread is not withdrawn by delivery rollers 1, 10 but by the rotating tube 2.

The invention has been described above with reference to examples of embodiment in which the reserve windings were produced from the thread 11 extending to the pneumatic thread-holding device. This is not a prerequisite for the present invention, however. For example, it is possible to grip the thread 11 such as coming from the thread supply source or removed from the thread holder device 27, in a slot 201 (FIG. 9) or in a notch at the end of the tube in known manner and to deflect the thread 11 by means of the auxiliary thread guide 3 (see FIG. 1) to form initial windings within the range 240 of the traversing thread guide 24. In this case, care must merely be taken to ensure that the thread guide 24 is not in this overlapping region 301 at this moment so that it can pick up the thread 11. One or two turns 13 are now laid in the overlapping region 301, after which the auxiliary thread guide 3 is swung back into the region 300 out of range 240 of the traversing thread guide 24, before the thread guide 24 comes into the overlapping region 301. The further turns 14 of the reserve winding are now formed in the region 300. When the reserve winding is sufficiently large, the auxiliary thread guide 3 is again swung into the range 240 of the traversing thread guide 24, where the thread guide 24 takes over the thread 11 and forms the main windings on the tube covering the initial reserve winding 13 in the overlap region 301.

With this method, too, a reserve winding is formed, the end of which is secured, but which can nevertheless easily be withdrawn from the end of the tube when needed for connection to the beginning of the thread of another bobbin.

Depending on the construction of the tube 2, fewer turns 13 may also be formed within the range 240 of the thread guide 24. If the surface of the tube is sufficiently rough or if a catching projection is provided—which may possibly be inserted in the tube 2 from the inside through a recess—one loop of thread may, in some circumstances, suffice to secure the thread 11 under the turns later laid by the thread guide 24.

While a preferred embodiment of the invention has been described using specific terms, such description is for illustrative purposes only, and it is to be understood that changes and variations may be made without departing from the spirit or scope of the following claims.

What is claimed is:

1. A device for securing a reserve winding on a tube supported by winding apparatus having a thread delivery source, drive means for rotating said tube causing said thread to be wound thereon, a traversing thread guide member for traversing along said tube causing said thread when grasped thereby to be uniformly wound along the length of said tube, and a thread-holding device disposed in the vicinity of a path of the thread from said thread delivery source to said tube for receiving and holding a portion of said thread, said device for securing a reserve winding comprising:

an auxiliary thread guide disposed adjacent said tube in the region of said reserve winding between said thread-holding device and said tube for receiving a length of said thread extended from said thread source to said thread holding device and guiding said thread held by said thread holding device to said tube for forming said reserve winding;

thread-catching means carried by said tube for grasping said thread guided by said auxiliary thread guide, said auxiliary thread guide guiding thread extending from said thread delivery source to said tube to be grasped by said traversing thread guide while causing said thread extending from said thread holding device to said tube to form said reserve windings on said tube; and means for movably carrying said auxiliary thread guide adjacent said tube for movement towards the center of said tube and means for producing a free end in said thread extending to said thread holding device, said auxiliary thread guide including a thread-deflection guide for deflecting said thread guided thereby towards the center of said tube when so moved causing said free end of thread to be covered by thread grasped and laid by said traversing thread guide securing said reserve winging on said tube.

2. A device as claimed in claim 1 wherein said auxiliary thread guide includes a pair of thread-deflection guides between which said thread is guided parallel to the surface of said tube, said thread-catching means including a thread catching projection carried and oriented on said tube in the direction of rotation of said tube between said two thread-deflection guides for grasping said thread held therebetween.

3. A device as claimed in claim 1 wherein said auxiliary thread guide is carried for linear displacement along the length of said tube.

4. A device as claimed in claim 1 wherein said auxiliary thread guide is carried adjacent said tube for pivotal movement toward the longitudinal center of said tube.

5. A device as claimed in claim 1 wherein a supporting means is provided in front of the winding roller on which said auxiliary thread guide can be mounted.

6. A device for securing a reserve winding on a tube supported by winding apparatus having a thread delivery source, drive means for rotating said tube causing said thread to be wound thereon, a traversing thread guide member carried adjacent said tube longitudinally movable for traversing said tube causing said thread when grasped thereby to be uniformly wound along the length thereof, and a thread-holding device disposed in the vicinity of the path of the thread from said thread delivery source to said tube for receiving and holding a portion of said thread extended from said thread source, said device for securing a reserve winding comprising:

a thread catching projection carried on said tube oriented in the direction of rotation of said tube;

a holder assembly;

auxiliary thread guide means carried by said holder assembly including a first thread-deflection guide for receiving a length of thread extending to said thread-holding device and a second thread deflection guide spaced from said first deflection guide between which said thread is held substantially parallel with said tube with the remaining length of thread extended from said second deflection guide to said thread delivery source;

a space defined between said first and second thread-deflection guides through which said thread-catching projection passes to grasp said thread held therebetween; and means for supporting said holder assembly adjacent said tube within the working range of said thread-catching projection means causing said thread held between said first and second deflection guides to be grasped by said thread-catching projection, said second thread deflection guide causing said thread extending from said thread delivery source to said tube to come within the range of said traversing thread guide and to subsequently be grasped by said traversing thread guide whereby said thread is uniformly wound along the length of said tube while said first thread-deflection guide causes said thread extending to said thread holder device to form said reserve windings.

7. A device as claimed in claim 6 further comprising thread-cutting means carried by said holder assembly for severing said thread extending to said thread-holding device producing a free end of reserve thread.

8. A device as claimed in claim 7 wherein said holder assembly is carried for movement towards the longitudinal center of said tube for deflecting said free end towards said center causing said free end to be wound under thread which is guided and laid by said traversing thread guide securing said reserve winding on said tube.

9. A device as claimed in claim 6 wherein said thread-catching projection includes means for removably fitting said projection to the tube.

10. A device as claimed in claim 6 wherein said means for supporting said holder assembly includes a handle portion carried on said holder assembly by which it is manually supported.

11. A device as claimed in claim 6 wherein said second thread-deflection guide guides said thread extending from said second thread-deflection guide to said thread supply source in the range of said traversing thread guide causing said thread to be engaged by said traversing thread guide immediately subsequent to said thread being grasped by said thread catching projection.

* * * * *